United States Patent [19]

Rebhan

[11] Patent Number: 4,939,842

[45] Date of Patent: Jul. 10, 1990

[54] CASING FOR A POWER DRIVEN CHAIN SAW

[76] Inventor: Franz Rebhan, Am Birkenbach 31, 8729 Eltmann, Fed. Rep. of Germany

[21] Appl. No.: 218,289

[22] PCT Filed: Sep. 23, 1987

[86] PCT No.: PCT/DE87/00436

§ 371 Date: May 20, 1988

§ 102(e) Date: May 20, 1988

[87] PCT Pub. No.: WO88/03858

PCT Pub. Date: Jun. 2, 1988

[30] Foreign Application Priority Data

Nov. 25, 1986 [DE] Fed. Rep. of Germany ..... 3640162

[51] Int. Cl.[5] ..... B27B 17/02

[52] U.S. Cl. ..... 30/386; 30/383

[58] Field of Search ..... 30/383, 381, 382, 384–387; 24/590, 591; 123/198 D, 198 DC; 83/DIG. 1

[56] References Cited

U.S. PATENT DOCUMENTS

| | | | |
|---|---|---|---|
| 1,046,169 | 12/1912 | Frederick | 474/126 |
| 3,636,995 | 1/1972 | Newman | 30/386 |
| 3,870,125 | 3/1975 | Gorski | 30/383 X |
| 3,974,566 | 8/1976 | Pilatowicz | 30/382 |
| 4,117,594 | 10/1978 | Arbuckle | 30/381 |
| 4,382,334 | 5/1983 | Reynolds | 30/386 |
| 4,385,442 | 5/1983 | Nitschmann et al. | 30/382 |
| 4,457,650 | 7/1984 | Tseng | 410/111 |
| 4,567,658 | 2/1986 | Wissmann et al. | 30/386 |
| 4,683,659 | 8/1987 | Wunsch et al. | 30/383 |
| 4,819,332 | 4/1989 | Sugihara et al. | 30/383 X |

*Primary Examiner*—Frank T. Yost
*Assistant Examiner*—Rinaldi Rada

[57] ABSTRACT

In order to construct a rail supporting means on the casing for a power driven chain saw in such a way that, when the saw chain is placed in position, the saw rail is already retained relatively firmly and is adjustable by means of the saw chain tightening device, a casing for a power driven chain saw is provided with a drive unit driving the saw chain revolvingly via the saw rail with a rail supporting means with two fastening bolts penetrating a slot-like aperture constructed in the saw rail and a saw chain tightening device arranged within the area of the rail supporting means and a sprocket wheel cover which can be secured to the casing that overlaps and covers the rail supporting means, the sprocket wheel cover (10) being constructed in two portions and comprising a protective cover (20) and a clamping cover (30), the clamping cover (30) being provided with two perforations (12*a*, 13*a*) through which the bolts (12,13) are able to penetrate and it being possible for said clamping cover to be mounted by means of the saw rail retaining nuts (12*b*, 13*b*) which may be fitted onto the bolts (12,13) (FIG. 1).

9 Claims, 4 Drawing Sheets

CASING FOR A POWER DRIVEN CHAIN SAW

BACKGROUND OF THE INVENTION

The casing according to the present invention can be used wherever a casing for power driven chain saws is to be constructed. In this case the invention relates to a casing for a power driven chain saw with a drive unit driving the chain revolvingly via the saw rail with a rail supporting means consisting of two fastening bolts penetrating a slot-like aperture provided in the saw rail and a saw chain tightening device arranged within the area of the rail supporting means as well as a sprocket wheel cover overlapping and covering the rail supporting means that can be secured to the casing.

In the known power driven chain saws a casing divided into two or more portions is used, in which a drive unit, by way of example, a combustion engine or an electromotor, is disposed which drives the saw chain revolvingly via the saw rail by means of a sprocket wheel. In this case, the saw rail, which is also referred to as "saw sword", is provided with a slot-like aperture into which penetrate two fastening bolts arranged on the casing. The saw rail is secured by means of retaining nuts screwed onto the fastening bolts.

In order to tighten the saw chain, the saw rail is displaced. This is done by loosening the saw rail fastening screws and by actuating a saw chain tightening device for displacing the saw rail, as a consequence of which the fastening bolts are displaced within the slot-like aperture. In power driven chain saws of this type the saw rail retaining nuts serve at the same time for securing the sprocket wheel cover overlapping and covering the sprocket wheel and the rail supporting means. If the chain is to be replaced now, It will be necessary not merely to loosen the rail retaining nuts, but to screw them off completely from the fastening bolts in order to be able to remove the sprocket wheel cover. In the course of this operation there exists the risk, particularly when working in forests, of the fastening nuts being lost. In addition, the handling of such a power driven chain saw is exceedingly complicated when replacing the chain since, once the sprocket wheel is removed, the saw rail, too, is no longer attached and is held loosely on the fastening bolt, so that it is possible only with difficulties to arrange the saw chain around the saw rail. It would therefore be desirable for the saw rail to be already mounted relatively firmly, but adjustably and with fitted retaining nuts on the casing when the saw chain is placed in position. Over and above that, the disadvantage exists in the known saws that, when the saw chain is placed inaccurately upon the saw rail and the clamping screws are subsequently tightened, the chain tightening device frequently is destroyed.

When adjusting the chain tension it has been necessary up till now to actuate a chain tightening device which, when seen from the assembly side, is located behind the saw rail. If, when placing the saw chain in position, it is now intended to bring about a change in the position of the saw rail, it will be necessary to grip the saw rail from behind, which entails a risk of injury because the engagement claws of the power driven chain saw are often arranged behind the saw rail.

In a construction of a power driven chain saw which has become known, the chain tightening device is intended to be actuated through the sprocket wheel cover from the assembly side. However, also in this chain saw the sprocket wheel cover is already mounted when the tightening device can be actuated. A saw chain tightening device which can be actuated without difficulties when the sprocket wheel cover is removed is not known up to the present.

SUMMARY OF THE INVENTION

By the present invention, a rail supporting means on the casing of a power driven chain saw is to be constructed in such a way that, when the saw chain is placed in position, the saw rail is already mounted relatively firmly and is adjustable by means of the saw chain tightening device. In addition, the known tipping of the saw sword during the assembly is to be entirely preventable. At the same time it is the object of the present invention to provide a saw chain tightening device which can be actuated from the assembly side of the saw rail, i.e. within the area of the sprocket wheel cover plane, even when the sprocket wheel cover, which can be fitted as a protection against the possible flying off of a chain, is removed.

In order to solve this technical problem, a casing for a power driven chain saw with a driving unit driving the saw chain revolvingly via the saw rail with a rail supporting means consisting of two fastening bolts penetrating a slot-like aperture constructed in the saw rail and a saw chain tightening device arranged within the area of the rail supporting means and a sprocket wheel cover which overlaps and covers the rail supporting means which can be secured to the casing is proposed, in which, in accordance with the invention, provision is made for the sprocket wheel cover to be constructed in two portion and which comprises a protective cover and a clamping cover, the clamping cover being provided with two perforations through which the bolts are able to penetrate and which can be mounted by means of the saw rail retaining nuts that can be fitted onto the bolts.

By means of this design, the attendant disadvantages when mounting the saw rail onto the known casing are avoided. Subsequent to the removal of the protective cover and a slight loosening of the retaining nuts and a slackening of the saw sword, it will be possible to simply place the saw chain into position without it being necessary to completely remove the retaining nuts.

In order to construct a casing in the manner explained and detailed in the foregoing, provision has been made by way of preference for the protective cover to have a mounting strip within the contact area of the protective cover with the clamping cover, said mounting strip being both constructed and arranged so as to grip the clamping cover from underneath. Hereby a secure mounting of the protective cover on the clamping cover is possible.

The clamping cover is preferably provided with a retaining member both passing through the same as well as being rotatably secured in the same, which, at one of its extremities facing the outside of the casing, is provided with a drive means and, at its other extremity, with two engagement arms projecting perpendicularly relative to the longitudinal axis of the retaining member, and in that the protective cover is provided with a slot-like aperture in the mounting strip, through which the retaining member extremity supporting the engagement arms is able to penetrate. By means hereof a rapid locking means has been provided rendering possible a quick assembly or disassembly of the protective cover on the clamping cover. In addition, the retaining member is preferably acted upon by a compression spring and the inside of the mounting strip of the clamping cover is provided with an engagement profile so that an inadvertent loosening of the rapid locking means can be prevented.

At the same time the protective cover is preferably provided with a number of fastening screws penetrating through the protective cover and rotatably secured in the same and engaging into corresponding tapped holes constructed in the casing. These additional fastening screws render possible an attachment of the protective cover on the casing so that, even when the casing portions are subjected to the greatest stress, a certain protection against injuries due to a possible flying off of the chain is ensured.

According to another solution of the technical problem provision has been made that in a casing of the aforesaid type it is planned that the bolt, at its extremity projecting into the slot-like aperture, is provided with a gear wheel arranged so as to mesh with a gear rack disposed in the slot-like aperture. With this construction of a chain saw tightening device, a rapid tightening or slackening is possible, it also being possible for these operations to be carried out while the protective cover is removed so that, subsequent to the placing into position or prior to the removal of the saw chain, a tightening or a slackening is possible. At the same time, a risk of injury on the engagement claws or on the saw chain no longer exists. In this case, provision is preferably made for the gear wheel being fabricated from a heavy-duty steel so that the wear acts unilaterally on the gear rack. This is advantageous since saw chains have to be replaced anyhow after a certain length of operation. Further advantageous embodiments of the invention are characterized in the subclaims.

BRIEF DESCRIPTION OF THE DRAWINGS

In the drawing, embodiments of the invention are depicted, in which.

DETAILED DESCRIPTION OF THE PREFERRED EMBODIMENT

Figure 1:
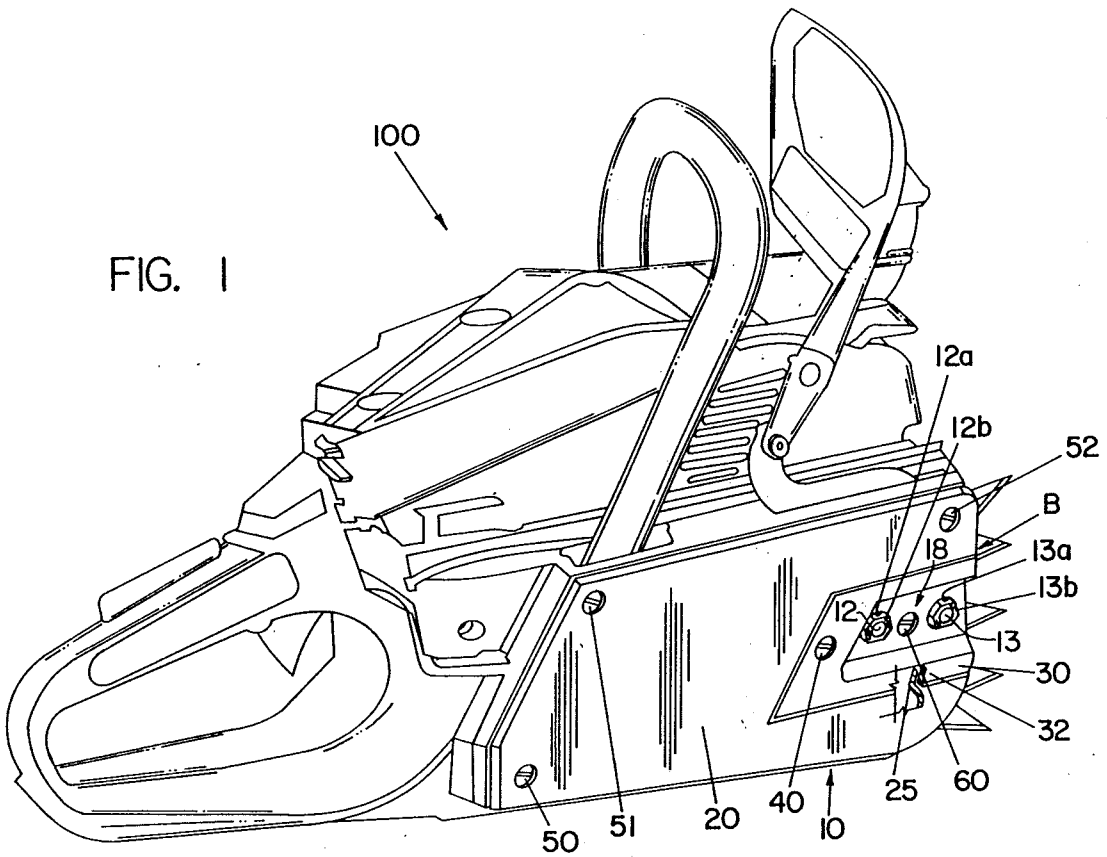
FIG. 1 shows a power driven chain saw casing with a dismantled saw rail but with a mounted sprocket wheel cover in a diagrammatical side view.
Figure 2:
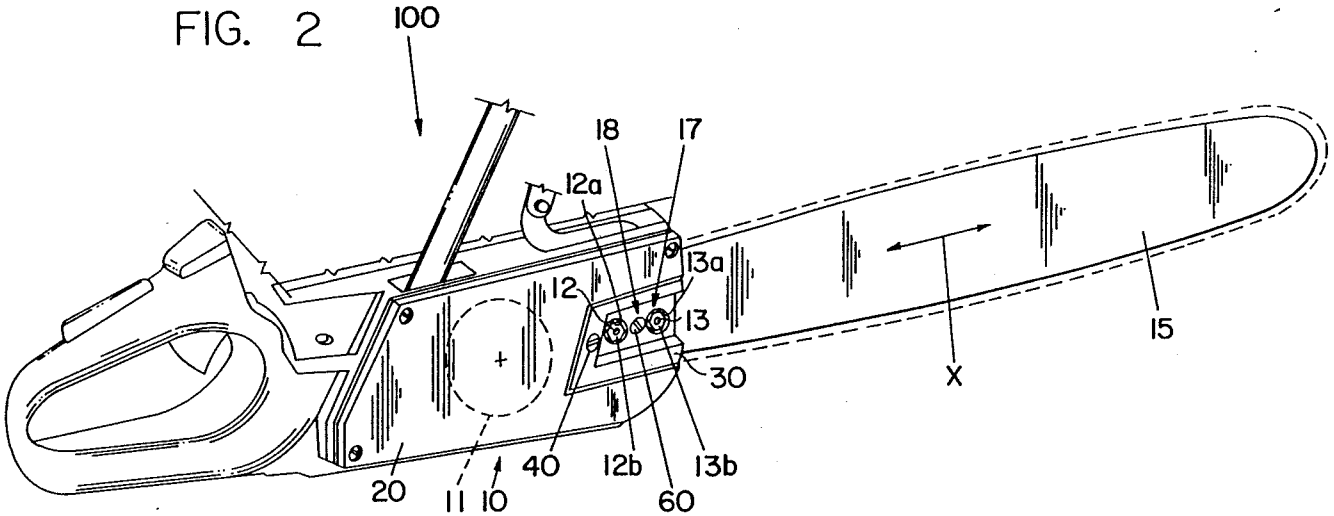
FIG. 2 shows a power driven chain saw casing with the saw rail in a diagrammatical side view.

In the FIGS. 1 and 2, a casing identified by 100 of a power driven chain saw is shown which, in its lateral area, is provided with a sprocket wheel cover 10 covering both the sprocket wheel 11 and the rail supporting means 17. In this case the sprocket wheel cover 10 consists of a protective cover 20 and a clamping cover 30 which jointly form the sprocket wheel cover 10 which, in its overall configuration, corresponds to that of the known sprocket wheel covers.

The clamping cover 30 is moreover provided with perforations **12*a*, 13*a*, through which the bolts 12,13 of the rail supporting means 17 penetrate. With the aid of the rail retaining nuts 12*b*,13*b* placed onto the bolts 12,13, the clamping cover 30 is secured to the bolts 12,13. Within the contact area B of the protective cover 20 with the clamping cover 30, the protective cover 20 is provided with a mounting strip 25 which grips underneath the clamping cover 30 within the area of its marginal zone 32. In addition, a retaining member 40 is provided within the marginal zone of the clamping cover 30 which, at one of its extremities 31 facing the outside of the casing, is provided with a drive means 42**. This may be constructed as a screw head for a screw driver to engage into or as a hexagon head or a hexagonal recess for a wrench.

Figure 3:
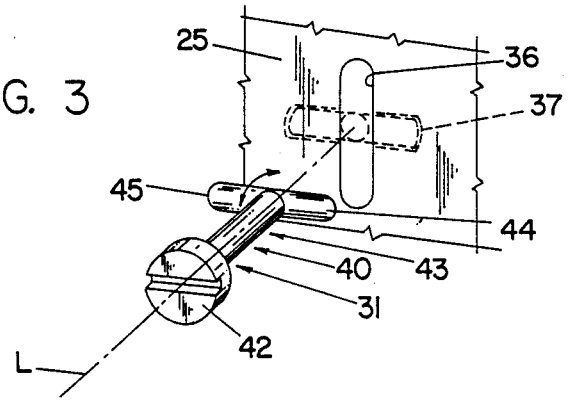
FIG. 3 shows a rapid locking means for a protective cover in a diagrammatical view.

Furthermore, the retaining member 40, as depicted in FIG. 3, at its other extremity 43, has two engagement arms 44,45 projecting perpendicularly relative to the longitudinal axis L of the bolt, said arms being insertable into a slot-like aperture 36 in the mounting strip 25 of the protective cover 20. The side of the mounting strip 25 which faces the inside of the casing is, within the area of the aperture 36, provided with an engagement profile 37. By means of a rotation of the retaining member 40, the engagement arms 44,45 are, in the process, introduced into the engagement profile 37 and retained by the same so that a loosening of the retaining member 40 is not possible. As the retaining member 40 is arranged in the clamping cover so as to penetrate the same and to be rotatably attached to the same, the protective cover 20 is thus connected to the clamping cover 30 with a rapidly actuatable locking means.

As is shown in the FIG. 1, provision can be made for the protective cover 20 to be additionally secured by means of the screws 5O,51,52 countersunk in the cover surface.

Over and above that, the clamping cover is additionally provided with the saw chain tightening device 18. Said tightening device is actuated by means of bolt 60 likewise disposed in the clamping cover 30, by means of which, by a rotation of the bolt 60, a displacement of the saw rail, or saw bar 15 in the direction X can be effected.

Figure 4:
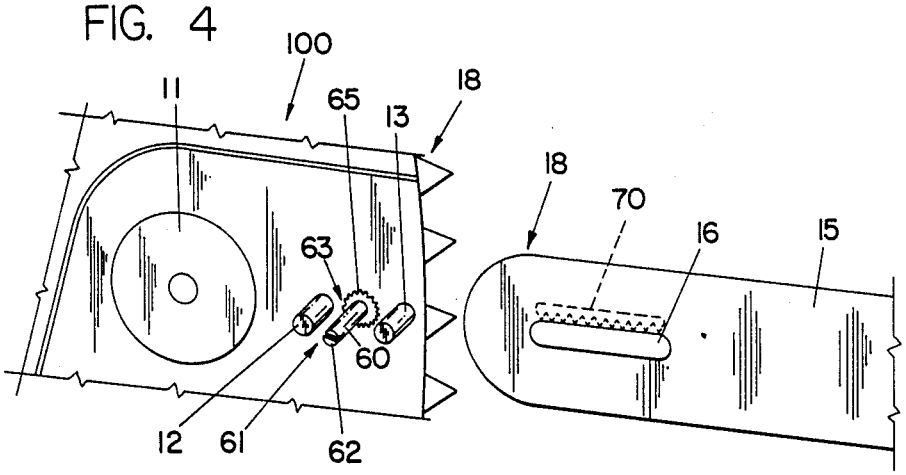
FIG. 4 shows a casing for a power driven chain saw with a rail supporting means and a saw rail in the disassembled state in a partial view.
Figure 5:
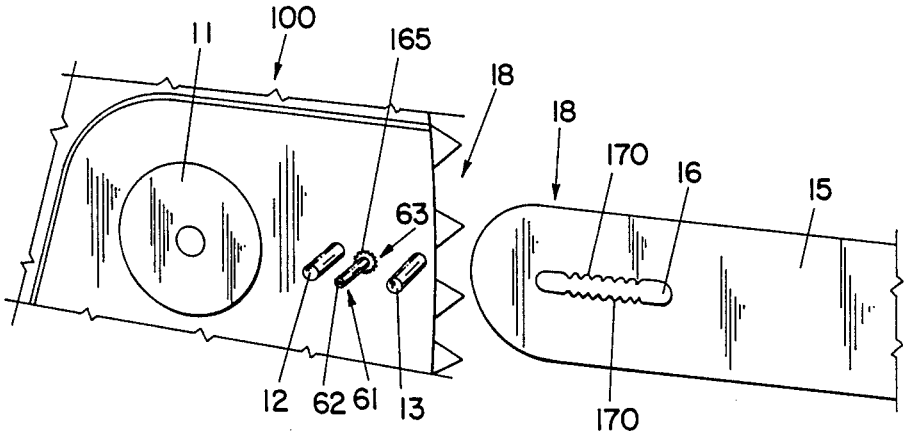
FIG. 5 shows a further embodiment of a casing of a power driven chain saw with a rail supporting means and a saw rail in the disassembled state in a partial view.

In the FIGS. 4 and 5 embodiments of the saw chain tightening device 18 are shown. In the embodiment according to FIG. 4, the bolt 60 is disposed between the bolts 12,13 and is rotatably supported in the casing 100, said bolt being provided with a drive means 62 at one of its extremities 61 facing the outside. Said drive means may be constructed as a screw head for a screw driver to engage into or as a hexagon head or hexagonal recess. At its other extremity 63, the bolt 60 is provided with a gear wheel 65 which, when the saw rail is placed upon the bolts 12,13, meshes with a gear rack 70 arranged above the slot-like aperture 16.

In the embodiment according to FIG. 5, in contrast to FIG. 4, provision is made for the slightly smaller gear wheel 165 to mesh with a gear rack 17O disposed in the slot-like aperture 16 when the saw rail 15 is placed upon the bolts 12,13. It is also possible to arrange two gear racks 7O,17O. If the gear wheels 65;165 are now rotated above the bolt 60, the saw rail 15 is displaced within the area predetermined by the bolts 12,13 and the slot-like aperture 16, as is shown by way of indication in FIG. 5 within the slot-like aperture 16.

However, the construction of the saw chain tightening device 18 with the aid of the gear wheel/gear rack combination has to be regarded as an embodiment only. It is just as possible to arrange, on the bolt 60, a step-by-step motion linkage not shown in the drawing and to connect the same in a suitable manner with the saw rail. It is essential in this connection that the saw chain tightening device can be actuated with the clamping cover 30 in the assembled state.

Figure 6:
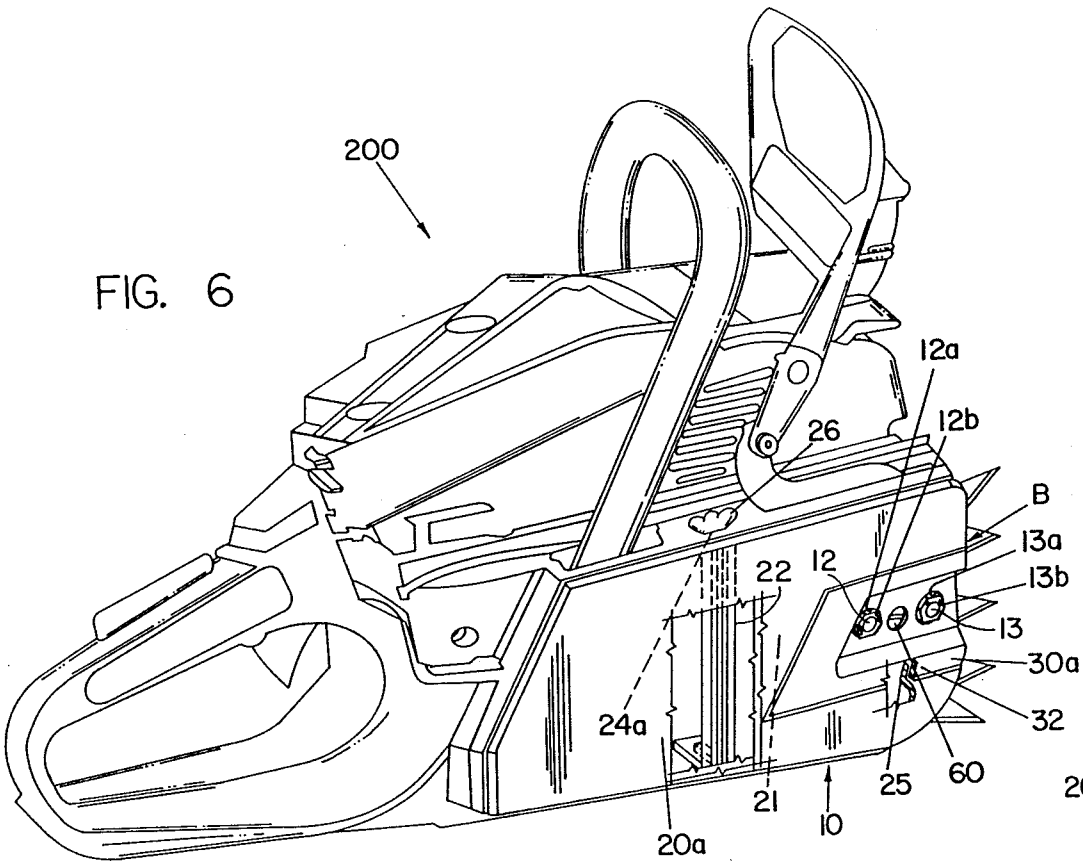
FIG. 6 shows a further embodiment of a casing for a power driven chain saw with a dismantled saw rail but with a mounted sprocket wheel cover in a diagrammatical side view.

In FIG. 6, a casing 200 is depicted with a further embodiment of a sprocket wheel cover. In this case the sprocket wheel cover 10 likewise consists of a protective cover 20*a* and a clamping cover 30*a*, which covers jointly constitute the sprocket wheel cover 10. The clamping cover 30*a* is here secured by the bolts 12, 13 penetrating the perforations 12*a*, 13*a*, onto which the rail retaining nuts are screwed. Within the contact area B of the protective cover 20*a* with the clamping cover 30*a*, the protective cover 20*a* is likewise provided with a mounting strip 25 which grips underneath the clamping cover 30*a* within its marginal zone 32.

However, on the inside 21 of the protective cover 20*a*, a mounting sleeve 22 provided with a longitudinal slot 23 is disposed and irremovably secured to the cover. In this case the casing 200 is provided with a casing aperture 24*a* and a mounting plate 27 irremovably secured to the casing in such a way that, when the protective cover 20*a* is attached to the casing, a mounting bolt 24 can be inserted through the mounting sleeve 22, whereby the hook-shaped foot portion 35 of the mounting bolt 24 is guided inside the longitudinal slot 23 of the mounting sleeve 22. At the same time, the mounting bolt 24 is so dimensioned in its length that, with its hook-shaped foot portion 35, it is able to penetrate and grip underneath the penetration opening 27*a* of the mounting plate 27, the hook-shaped foot portion, when the mounting bolt 26 is rotated, can be guided slidingly via a notch 27*b* in the mounting plate 27, so that the mounting bolt 24 is arrested by the notch 27*b* and prevented from rotating. In this position the hook-shaped foot portion 35 simultaneously acts upon the ignition interrupting switch 28, as a consequence of which the ignition is not interrupted when said switch is acted upon.

When the mounting bolt head 26 is rotated and the hook-shaped foot portion 35 is returned toward the longitudinal slot 23 via the notch 27*b*, the ignition of the combustion engine is immediately interrupted by the ignition interruption switch 28. In this fashion it is possible to achieve that a removal of the protective cover 20*a* is not possible while the combustion engine is in operation.

Figure 7:
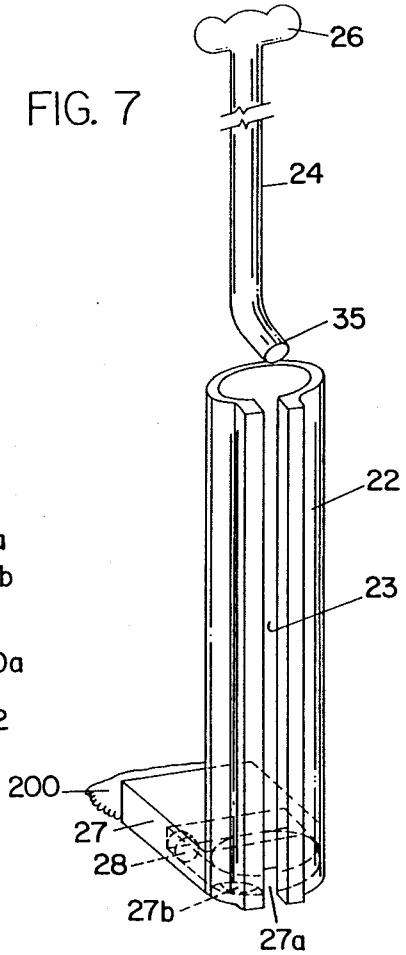
FIG. 7 shows a mounting bolt and a mounting sleeve according to FIG. 6 in an enlarged view.

In order to loosen the protective cover 20*a* following the return of the foot portion 35 into the longitudinal slot 23 via the notch 27*b*, it will only be necessary to pull the mounting bolt 24 upward and out of the mounting sleeve 22 altogether (FIG. 7). The protective cover 20*a* is loosened thereby and can be drawn across underneath the clamping cover 30*a* and be pulled off. In this way it is possible to remove the protective cover 20*a* merely by loosening a bolt and, for instance, to replace the saw chain without it being necessary to loosen the clamping cover or to screw off the rail retaining nuts.

What is claimed is:

1. A casing for a power driven chain saw with a drive unit having a sprocket wheel driving a saw chain revolvingly on a saw rail, a rail supporting means having two fastening bolts penetrating a slot-like aperture constructed in the saw rail, a saw chain tightening device arranged within the area of the rail supporting means and a sprocket wheel cover that can be secured to the casing and covers the sprocket wheel and the rail supporting means, characterized in that the sprocket wheel cover (10) is constructed in two portions which comprise a protective cover (20) and a clamping cover (30) separable from the protective cover, the protective cover being contoured in the area of the chain tightening device to receive the clamping cover such that each of the protective cover and the clamping cover defines an outer exterior surface on the sprocket wheel cover, and the clamping cover (30) cooperating with the rail supporting means for holding the saw rail to the casing.

2. A casing according to claim 1, characterized in that the protective cover (20), within said contoured area further having a contact area (B) and the clamping cover (3), has a mounting strip (25) which is constructed and arranged so as to grip underneath the clamping cover (3).

3. A casing according to claim 1, characterized in that the clamping cover (30) is provided with a retaining member (40) both passing through the same as well as being rotatably mounted in the same which, at its one extremity (31) facing the outside of the casing, is provided with a drive means (42) and, at its other extremity (43), has two engagement arms (44, 45) projecting perpendicularly relative to the longitudinal axis of the bolt (L), and in that the protective cover (20) is provided with a slot-like aperture in the mounting strip (25), through which the other extremity (43) of the retaining member (40) supporting the engagement arms (44, 45) is able to penetrate.

4. A casing according to claim 1, characterized in that the protective cover (20) is provided with a number of fastening screws (50,51,52) which pass through the protective cover (20) and are rotatably secured in the same and which engage into corresponding tapped holes constructed in the casing (100).

5. A casing according to claim 1 characterized in that the protective cover (20), on its inner side (21) facing away from the outside (31) of the casing, supports a mounting sleeve (22) provided with a longitudinal slot (23), in that a mounting bolt (24), after having been passed through a casing aperture (24*a*), is disposed so as to be insertable through the mounting sleeve (22) and, with a hook-shaped foot portion (25), so as to pass through and grip underneath a mounting plate (27) irremovably secured to the casing, and in that the mounting bolt (24) with the mounting bolt head (26) can be retained on the casing (200), and with the hook-shaped foot portion (25) on the mounting plate (27) for mounting the protective cover (20) on the casing (200).

6. A casing according to claim 5, characterized in that, on the mounting plate (27), within an area acted upon by the hook-shaped portion (25), an ignition interruption switch (28) is arranged.

7. A casing for a power driven chain saw having a drive unit having a sprocket wheel driving a saw chain revolvingly on a saw rail, a rail supporting means including two fastening bolts passing through a slot-like aperture constructed in the saw rail, a saw chain tightening device arranged within the area of the rail supporting means and a sprocket wheel cover that can be secured to the casing and covers the sprocket wheel and the rail supporting means, characterized in that a mounting plate is fixedly secured to the casing adjacent one edge of the sprocket cover, the sprocket wheel cover (10) is constructed in two portions and comprises a protective cover (20) and a clamping cover (30) separable from the protective cover, the clamping cover cooperating with the rail supporting means for holding the saw rail to the casing, the protective cover (20) on the inner side (21) facing the casing supports a mounted sleeve (22) provided with a longitudinal slot (23), and a mounting bolt (24) with a hook-shaped foot portion (35) at one end and a bolt head (26) at the opposite end is insertable in the mounted sleeve for mounting the protective cover (20) on the casing (200), the bolt after passing through a casing aperture (24*a*), being slidable through the mounting sleeve (22) to engage the foot portion with the mounting plate (27) fixedly secured to the casing.

8. The casing according to claim 7 wherein an ignition interruption switch (28) for interrupting the ignition circuit of the chain saw is mounted within an area acted upon by the hook-shaped portion (35) of the mounting bolt, and the hook-shaped portion actuates the switch to close the ignition circuit when the bolt is engaged with the mounting plate to secure the protective cover to the casing.

9. The casing according to claim 1 wherein the clamping cover is provided with two perforations (12*a*, 13*a*) through which bolts (12, 13) pass, the clamping cover being mounted and held on the bolts by means of the saw rail retaining nuts (12*b*, 13*b*).

* * * * *